US005439556A

United States Patent [19]

Sethna et al.

[11] Patent Number: 5,439,556

[45] Date of Patent: Aug. 8, 1995

[54] OXIDATION OF WHITE LIQUOR USING A PACKING COLUMN

[75] Inventors: Rustam H. Sethna, New Brunswick; Mark J. Kirschner, Morristown; Richard W. Potthoff, Scotch Plains, all of N.J.

[73] Assignee: The BOC Group, Inc., New Providence, N.J.

[21] Appl. No.: 143,590

[22] Filed: Nov. 1, 1993

Related U.S. Application Data

[63] Continuation-in-part of Ser. No. 107,102, Aug. 16, 1993, abandoned.

[51] Int. Cl.[6] ..... D21C 11/04

[52] U.S. Cl. ..... 162/30.11; 162/29; 162/239; 422/185; 423/551

[58] Field of Search ..... 162/30.11, 29, 239; 423/551, 544, 659; 210/928, 761; 422/185, 234

[56] References Cited

U.S. PATENT DOCUMENTS

| | | | |
|---|---|---|---|
| 2,758,017 | 8/1956 | Allen et al. | 23/283 |
| 3,647,363 | 3/1972 | Chart et al. | 23/25 |
| 3,860,479 | 1/1975 | Barker et al. | 162/79 |
| 4,024,229 | 5/1977 | Smith et al. | 423/562 |
| 4,053,352 | 10/1977 | Hultman et al. | 162/29 |
| 4,431,617 | 2/1984 | Farin | 423/232 |
| 4,704,135 | 11/1987 | Bonasso et al. | 48/73 |
| 5,082,526 | 1/1992 | Dorris | 162/30.11 |
| 5,143,702 | 9/1992 | Der et al. | 422/185 |
| 5,171,405 | 12/1992 | Torregrossa | 162/243 |
| 5,201,172 | 4/1993 | Hakulin et al. | 60/39.05 |

FOREIGN PATENT DOCUMENTS

| | | | |
|---|---|---|---|
| 0543135 | 5/1993 | European Pat. Off. . | |
| 2728554 | 6/1977 | Germany . | |
| 1260085 | 8/1988 | Japan | 162/30.11 |

OTHER PUBLICATIONS

Ayton, John R. "How White Liquor Oxidation Can Affect . . . Oxygen Delig Proc", CPTA Western Pac Ann Br Meeting, 1991, pp. 1–4.

Alper, E. and A. Palla, "Oxidation of Aqueous Sodium Sulphide Solutions Containing Fine Activated Carbon Particles at Elevated Temperatures," *The Chemical Engineering Journal,* 35 (1987) pp. 37–42.

Chandrasekaran, K. and M. M. Sharma, "Absorption of oxygen in aqueous solutions of sodium sulphide," *Chemical Engineering Science,* 1974, vol. 29, 2130–2132.

Pal, S. K., M. M. Sharma and V. A. Juvekar, "Fast Reactions in Slurry Reactors: Catalyst Particle Size Smaller than Film Thickness: Oxidation of Aqueous Sodium Sulphide Solutions with Activated Carbon Particles as Catalyst at Elevated Temperatures," *Chemical Engineering Science,* vol. 37, No. 2, pp. 327–336, 1982.

*Primary Examiner*—W. Gary Jones
*Assistant Examiner*—Dean Tan Nguyen
*Attorney, Agent, or Firm*—David M. Rosenblum; Larry R. Cassett

[57] ABSTRACT

A method of producing oxidized white liquor from white liquor in which sodium sulfide is oxidized to sodium sulfate. In accordance with the method, an oxygen containing gas is contacted with the white liquor at a temperature of at least 110° C. and such that the total pressure of oxygen and water vapor is no less than 9.2 atmospheres during the contacting.

10 Claims, 2 Drawing Sheets

OXIDATION OF WHITE LIQUOR USING A PACKING COLUMN

RELATED APPLICATIONS

This application is a continuation-in-part of U.S. Ser. No. 08/107,102 filed Aug. 16, 1993 now abandoned.

BACKGROUND

The present invention relates to white liquor utilized in the pulping of wood. Even more particularly, the present invention relates to a method of producing oxidized white liquor in which sodium sulfide contained within the white liquor is oxidized to sodium sulfate.

An initial stage in the production of wood pulp for paper making is the delignification of wood chips by the use of reprocessed white liquor. White liquor is typically an aqueous solution of sodium hydroxide (76 g/l), sodium carbonate (19 g/l), sodium sulfide (33 g/l) and sodium sulfate (2 g/l). The foregoing concentrations are exemplary only and each component could be more or less than that stated hereinbefore. The delignification creates black liquor which is concentrated in an evaporator. After concentration, the black liquor is burned in a furnace to produce an inorganic residue, known in the art as smelt. The smelt is dissolved in water to produce green liquor which is further processed in causticizing and clarifying stages to produce the white liquor. The white liquor is recycled back to the initial cooking stage. Some mills use oxidized white liquor (thiosulfate) for $O_2$ delignification.

The successive pulp bleaching stages can consist of oxygen delignification, chlorine dioxide, oxidative extraction, with or without hydrogen peroxide or separate peroxide stages. Peroxide in oxidative extraction stages is consumed by the sodium thiosulfate present in conventionally processed white liquor should the liquor be used as a source of alkali. Hydrogen peroxide is expensive and its depletion adds an unnecessary cost burden to the bleaching process.

It is known that it would be very advantageous to render the white liquor inert to expensive oxidizing agents such as peroxide by oxidation of the sodium sulfide. Thereafter the oxidized white liquor could be utilized within alkaline oxidizing bleaching stages. The use of such oxidized white liquor would make it possible not only to economically improve the pulp production process through a reduction of the consumption of peroxide but also, to improve the product quality of the pulp. To this end, oxidized white liquor has been produced in which sodium sulfide is oxidized to sodium thiosulfate. Further oxidation would of course render the sodium sulfide inert to the action of powerful oxidants such as hydrogen peroxide and chlorine dioxide, but the oxidation of sodium sulfide to sodium sulfate has proved to be impractical due to slow reaction rates.

As will be discussed, the present invention provides a method of producing oxidized white liquor by oxidizing the sodium sulfide in the white liquor to sodium sulfate at a sufficiently rapid reaction rate so as to make the use of sodium sulfate containing white liquor industrially practical.

SUMMARY OF THE INVENTION

The present invention provides a method of oxidizing sodium sulfide present within white liquor to sodium sulfate, thereby to produce oxidized white liquor. In accordance with such method, an oxygen containing gas and the white liquor are contacted at a temperature of at least about 110° C. and at a total pressure of at least 9.2 atmospheres absolute. In this regard, the term "oxygen containing gas" as used herein and in the claims means air, oxygen enriched air or oxygen. Furthermore, the term "total pressure" as used herein and in the claims means the sum of all partial pressures present during the reaction, for instance oxygen pressure, water vapor pressure, and etc.

In the prior art, sodium sulfide contained within white liquor is oxidized to produce sodium thiosulfate by introducing oxygen into the white liquor. The oxygen upon introduction has a pressure of between about 2.7 atmospheres absolute and 6.8 atmospheres absolute and the reaction between the oxygen and the sodium sulfide is conducted at a temperature of between about 70° C. and 100° C. Typically, the result of such reaction is that sodium thiosulfate is produced relative to sodium sulfate in a 3:1 ratio in grams per liter of salt. Several reactions are involved. Sodium sulfide is oxidized to elemental sulfur, polysulfide and then to sodium thiosulfate. The sodium thiosulfate is in mm oxidized to sodium sulfate. Additionally, sodium sulfide is oxidized to produce sodium sulfite, which is in mm further oxidized to produce sodium sulfate. The oxidation of sodium sulfide to sodium thiosulfate and sodium sulfite to sodium sulfate are very fast reactions, while the oxidation of sodium sulfide to sodium sulfite and sodium thiosulfate to sodium sulfate are very slow reactions.

Experimentation by the inventors herein has shown that the oxidations to sodium sulfite and sodium sulfate are hastened in accordance with increased temperature. However it is not enough to simply raise the temperature because as the temperature increases, so does the water vapor partial pressure. At the same time, the oxygen partial pressure decreases significantly. As a result, there must be a proportional increase in the total pressure at which the reaction is taking place to obtain the enhanced conversion. Put another way, the minimum oxygen pressure must be much more than the vapor pressure of the water at the reaction temperature and, preferably, the total pressure (water vapor and oxygen) during the reaction should be 9.2 atmospheres absolute or greater. As can be appreciated, such minimum oxygen pressure of 9.2 atmospheres absolute obtains when the oxygen containing gas fed to the a process in accordance with the present invention is a high purity oxygen. As the purity of the oxygen containing gas decreases to that of air the total pressure increases and at minimum would be about five times the total pressure if pure oxygen were used. A further point is that the only limit on the maximum total pressure is practicality. Although a process in accordance with the present invention could be conducted at significantly higher pressures, for instance 30 or 40 atmospheres, the compression of the oxygen containing gas to such higher pressures would add to the expense of conducting the process.

In an autoclave batch test of a solution containing approximately 12 g/L (all concentrations expressed as g/L of sulfur) sodium sulfide, about 4 g/L sodium sulfate, and about 3 g/L sodium thiosulfate, it was found by the inventors herein that under reaction conditions of about 190° C. and about 17 atmospheres, in approximately four minutes the test solution contained about 15 g/L sodium sulfate and near trace amounts of the sodium thiosulfate and sodium sulfide. It was found at about a half a minute, essentially all of the sodium sulfide had been converted, sodium sulfite peaked and was steadily decreasing and sodium thiosulfate had peaked but also was decreasing.

It therefore is apparent that in order to realize fast reaction times, the reaction should take place within a plug flow reactor which preferably comprises a tower utilizing structured packing. As used herein and in the claims, a plug flow reactor is any reactor in which contact between a gas and a liquid occurs in a direction normal to the flow of the liquid through the reactor. A plug flow reactor will be superior over, for instance, a CSTR (continuous stirred tank reactor) became of the short time interval to convert substantially all of the sodium sulfide to sodium sulfate coupled with the short duration residence times that can be expected within a plug flow reactor. A plug film reactor utilizing structured packing will be even more superior to reactions of the prior art due to the very thin film layers in which the necessary reactions take place. In any high sulfidity case, a column bottom for the plug flow reactor will provide additional residence time for reaction. It should be mentioned, at temperatures and pressures of the present invention, the conversion of sodium sulfide to sodium sulfate will also depend on the packing density within such a tower. As used herein and in the claims, the term "packing density" means a ratio of the surface area of a packing to its volume.

The reaction time contemplated in the present invention is in the order of seconds. In the prior art, the reaction would require reaction times in the order of minutes or even hours.

BRIEF DESCRIPTION OF THE DRAWING

Although the specification concludes with claims distinctly pointing out the subject matter that applicants regard as their invention, it is believed that the invention will be better understood when taken in connection with the accompanying drawings in which:

DETAILED DESCRIPTION

Figure 1:
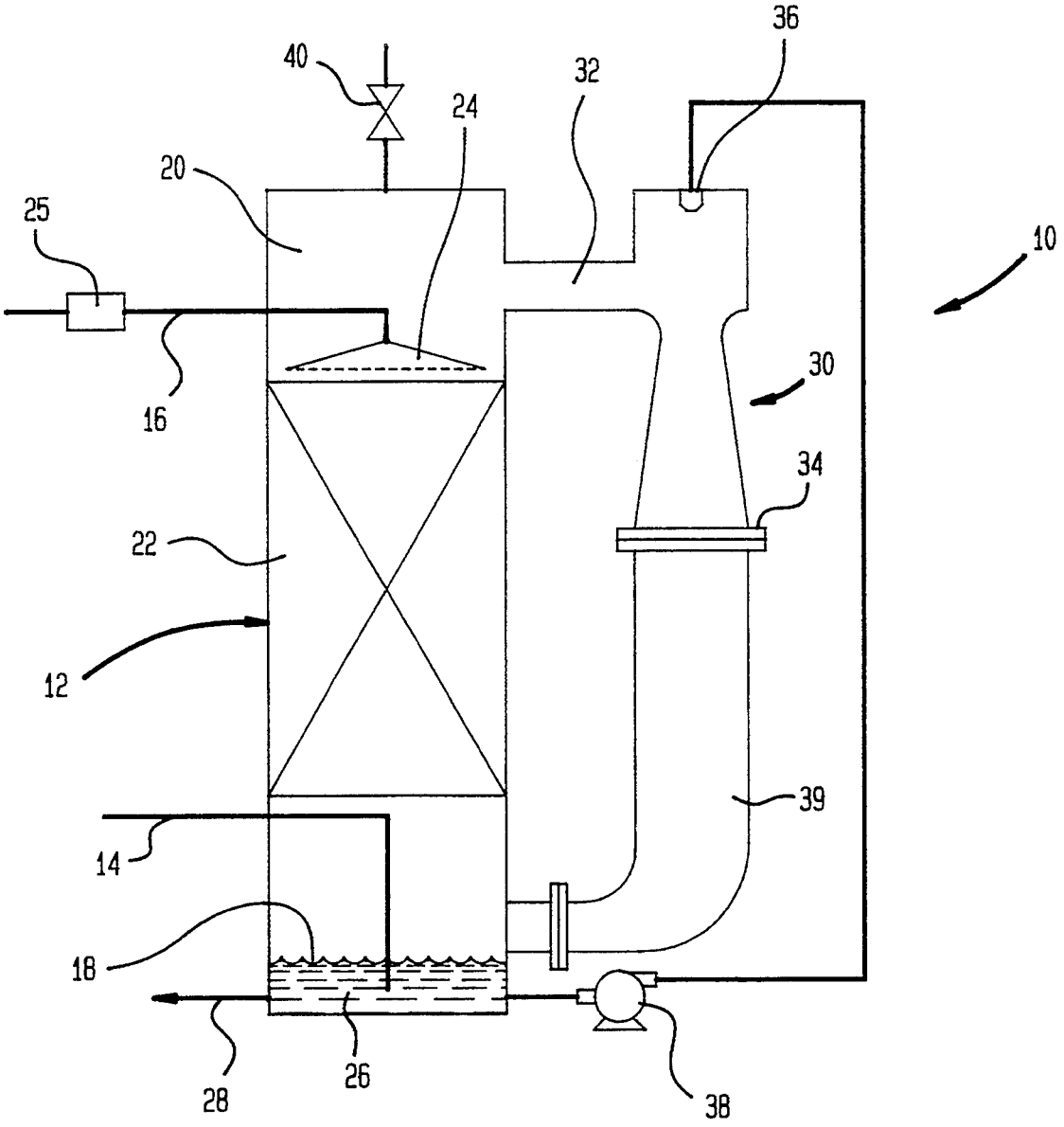
FIG. 1 is a schematic view of an apparatus for carrying out a method in accordance with the present invention.

With reference to FIG. 1, an apparatus 10 in accordance with the present invention is illustrated for producing oxidized white liquor. The feed to apparatus 10 would in practice be that portion of the white liquor that is to be used in the pulp bleaching stages. The other portion of the white liquor would be recycled back to the wood chip cooking stage of the process.

Apparatus 10 consists of a liquid/vapor contacting column 12 of approximately 9.84 meters in height by about 0.9 meters in diameter. Column 12 is provided with an oxygen inlet 14 and a white liquor inlet 16 to bottom and top regions 18 and 20 of column 10, respectively. An oxygen stream is introduced into the column through inlet 14 and a white liquor stream is introduced into the column through inlet 16.

The white liquor and oxygen are brought into intimate contact by contacting elements which are preferably formed by beds of structured packing designated by reference numeral 22. As would be known by those skilled in the art, liquid distributors would be located between pairs of beds. The white liquor is introduced into structured packing 22 by a liquid distributor 24 and the oxygen rises through the open area of structured packing 22. Structured packing is efficient and has a very low pressure drop. This allows the recycling of the gas stream with a blower. As will be discussed, a simple eductor is sufficient. It is to be noted that to preclude clogging of the packing by particulates, the packing type and crimp angle are important. In this regard, structured packing 22 can have a packing density of between about 500 $m^2/m^3$ and is preferably Koch Type 1X or 1Y which can be obtained from Koch Engineering Company, Inc. of Wichita, Kans. Random packing and trays could also be used with less effectiveness.

In order for the reaction to proceed as mentioned above, an oxygen containing gas can be used so long as the total pressure during the reaction does not drop below about 9.2 atmospheres absolute. The oxygen should have a purity as high as is economical with 90% and above being preferred. The reaction should proceed at a total pressure of no less than about 9.2 atmospheres absolute and more preferably at least about 11.2 atmospheres absolute. Additionally, the reaction between the oxygen and the sodium sulfide should occur at a minimum temperature of about 110° C. A minimum reaction temperature of about 120° C. is more preferred and reaction temperatures at or above 150° C. are particularly preferred. A particularly preferred temperature and pressure is about 200° C. and about 18 atmospheres absolute. As mentioned above, the minimum pressure for conducting a process in accordance with the present invention would increase five-fold in air.

The reaction of oxygen and sodium sulfide is an exothermic reaction. However, to start the reaction heat must be added to the white liquor to raise it to the requisite reaction temperature. To this end, a heat exchanger 25 can be provided before inlet 16 in which the incoming white liquor is heated by indirect heat exchange with steam. After the reaction progresses, heat exchanger 25 can be shut down. The heat exchanger could also be charged on the hot side with white liquor.

The oxidized white liquor collects as a column bottom 26 within bottom region 18 of column 12. A product stream 28 of the oxidized white liquor is removed from bottom region 18 of column 12 for use in the bleaching stages of the pulp making process. At the same time, an oxygen containing tower overhead collects within top region 20 of column 12.

It is possible to conduct a method in accordance with the present invention in which a stream of the column overhead is continually vented. In such case, a high rate, approximately three to four times the stoichiometric rate of pure oxygen would be supplied through oxygen inlet 14. This would produce excess oxygen, which when vented as tower overhead could be used for other oxygen applications elsewhere in the mill. In order to prevent cooling of the column through evaporation of water, the oxygen should be pre-saturated at the column temperature.

For the most common concentrations of sodium sulfide, it is necessary to recirculate the tower overhead rather than vent it so that the oxygen added into the column is a saturated gas at the desired column temperature. Cold, unsaturated gas can serve to cool the column and thereby inhibit the reaction. This recirculation is effected by pumping a stream of the column overhead into the bottom region 18 of column 12. Not only does this conserve oxygen, but also, it has been found to make the vapor/gas conditions (temperature, composition more uniform throughout the packing) and to flatten the vapor flux profiles along the column length. The end result is that less packing has to be utilized with recirculation because all parts of the column are operating in high efficiency regions.

Although a blower could be used to recirculate the tower overhead stream, it has been found that more efficiently, the tower overhead stream can be circulated by an eductor 30 having a low pressure inlet 32, a high pressure outlet 34, and a high pressure inlet 36. A stream of in-process white liquor is pumped by a pump 38 through eductor 30. Low pressure inlet 32 of eductor 30 draws the tower overhead stream from top region 20 of column 12. The pumped oxidized white liquor is introduced into a high pressure inlet 36 of eductor 30 and a combined stream of tower overhead and oxidized white liquor is discharged from high pressure outlet 34 of eductor 30. High pressure outlet 34 is connected by a conduit 39 to bottom region 18 of column 12 in order to circulate the oxygen-containing column overhead back into bottom region 18.

Stripped gas impurities and reaction products which may serve to dilute the tower overhead stream and thereby lower oxygen partial pressure can collect at the top of column 12. In order for such gas impurities and reaction products to not affect the reaction, they can be periodically or continually vented through the use of a small vent 40 provided for such purpose.

Although, not illustrated, the incoming white liquor feed could be preheated by introducing it into a heat exchanger located within bottom region 18 of column 12. The heat exchanger would be provided with a conduit connected to liquid distributor 24. Additionally, part of the pumped white liquor stream could be diverted from eductor 30 to white liquor inlet 16 to preheat the white liquor by direct heat exchange. In addition to preheating the white liquor feed through the use of a heat exchanger in bottom region 18 of column 12, an external heat exchanger utilizing steam could be used to further heat the white liquor feed prior to its entry into liquid distributor 24.

Typical industrial flow rates for apparatus 10 can be about 178.0 liters/min of white liquor containing about 30 g/l of sodium sulfide. The recirculation factor (recirculation rate in kg/sec. divided by rate that oxygen is supplied in kg/sec.) of tower overhead should be between about 3.0 and 4.0 to maintain an $F_s$ (allowable gas load or gas velocity x gas density$^{0.5}$) of between 1.0–1.3 $(m/s)(kg/m^3)^{0.5}$ where structured packing 22 (Koch FLEXIPAC 1Y) is most efficient. The resulting pressure drop is in the order of about 0.017 to about 0.008 meters of water per meter of packing. A 0.15 meter diameter eductor 30 (such as can be obtained from Baker Process Equipment Co., Inc., Corropolis, Pa.) with a large nozzle and a pumped white liquor flow of between about 303.0 liters/min. at about 1653.0 Kpa will produce the necessary gas recirculation. Consequently, only a very small recirculation pump need be used having low power requirements.

The following table illustrates the rapidity of the conversion within apparatus 12 for temperatures above about 155° C. and pressures above about 13 atmospheres. $\tau$ is the reactor residence time in minutes.

TABLE

| | Comparison of Residence Time $\tau$ | | |
|---|---|---|---|
| T° C. | Atmospheres | $\tau$ for high conversion of $Na_2S$ to $Na_2SO_4$ | Conversion to $Na_2SO_4$ |
| 155 | 14.61 | 10 to 12 | 99 |
| 165 | 14.61 | 7.0 | 99 |
| 185 | 14.61 | <5.0 | 99 |
| 145 | 18 | 40.0 | 99 |
| 160 | 18 | 8.0 | 99 |
| 200 | 18 | <4.0 | 99 |

Figure 2:
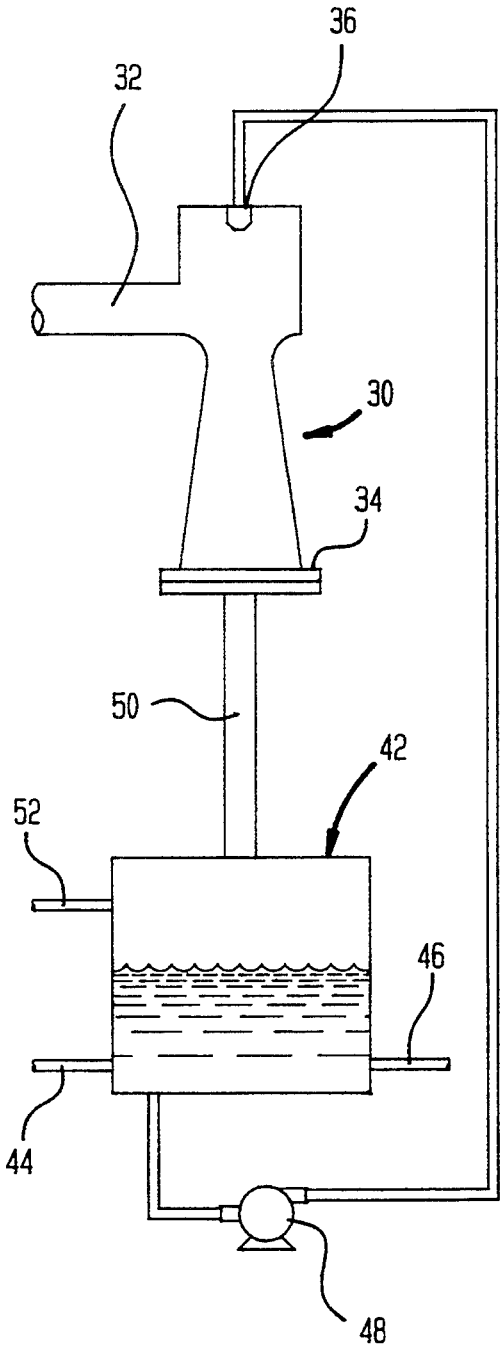
FIG. 2 is a fragmentary schematic view of an alternative embodiment of FIG. 1. Elements of such embodiment having the same description as those of FIG. 1 are designated by the same reference numerals as FIG. 1.

With reference to FIG. 2, an external coolant can be used, for instance water, as the motive fluid for the eductor. This is particularly advantageous when the white liquor has a high sulfide content and thus, the oxygen-sulfide reaction produces excessive temperatures. Since the column and eductor utilized for this embodiment are identical to column 12 and eductor 30, for simplicity of explanation, the same reference numbers as are used with respect to column 12 and eductor 30 are used in the explanation of this embodiment. The column is not illustrated.

In operation, the water is circulated through a phase separation tank 42 having an inlet 44 and an outlet 46. The water is pumped by a pump 48 through the high pressure inlet 36 of eductor 30 to draw tower overhead into the eductor through low pressure inlet thereof. In this regard, the embodiment is utilized with a column identical to column 12. The combined stream of tower overhead and cooling water is discharged from a high pressure outlet 34 of eductor 30 into phase separation tank 42 by means of a conduit 50. The tower overhead separates from the cooling water and collects in the top of phase separation tank 42 for introduction via a conduit 52 into the bottom of column 12, above the level of column bottom 26. In such manner, oxygen-containing gas is recycled while being cooled by cooling water.

While the invention has been illustrated in relation to a preferred embodiment, it will be understood by those skilled in the art that numerous additions, omissions and changes may be made without departing from the spirit and scope of the present invention.

We claim:

1. A method of oxidizing sodium sulfide present within white liquor to sodium sulfate, thereby to produce oxidized white liquor, said method comprising:

contacting an oxygen containing gas and the white liquor in a column having structured packing .to contact said oxygen containing gas with .said white liquor at a temperature of at least about 110° C. and a total pressure of at least about 9.2 atmospheres absolute by introducing a white liquor stream made up of said white liquor and an oxygen containing gas stream of said oxygen containing gas into top and bottom regions, respectively, of said column, thereby to form the oxidized white liquor as a column bottom and a tower overhead containing unreacted oxygen from the oxygen containing gas stream;

withdrawing a tower overhead stream from said top region of said column and reintroducing said tower overhead stream into said bottom region of said column to recirculate the unreacted oxygen as a saturated gas and at said temperature for further contact with said white liquor to conserve oxygen and create more uniform temperature and composition throughout the column; and withdrawing a product stream composed .of the oxidized white liquor from the bottom region of the column.

2. The method of claim 1, wherein the total pressure is at least about 11.3 atmospheres absolute.

3. The method of claim 1, wherein the temperature is at least about 120° C.

4. The method of claim 1, wherein the temperature is at least about 130° C.

5. The method of claim 1, wherein the total pressure is at least about 11.3 atmospheres absolute and the temperature is at least about 130° C.

6. The method of claim 1, wherein the total pressure is at least about 18 atmospheres absolute and the temperature is at least about 200° C.

7. The method of claim 1 wherein the structured packing has a density of about 500 $m^2/m^3$.

8. The method of claim 1, further comprising heating the white liquor to the reaction temperature to initiate the oxidation of the sodium sulfide and then utilizing the heat of reaction between-the sodium sulfide and the oxygen to continue the oxidation of the sodium sulfide.

9. The method of claim 1, wherein the tower overhead stream is withdrawn and reintroduced into the column by pumping a column bottom stream composed of the oxidized white liquor from the bottom of the column through an eductor having a low pressure inlet connected to the top of the column and through which the tower overhead stream is drawn and entrained in the column bottom stream to form a combined stream and a high pressure outlet connected to the bottom region of the column and through which the combined stream is introduced into the bottom region of the column.

10. The method of claim 1, wherein the tower overhead stream is withdrawn and reintroduced into the column by:

pumping a coolant through an eductor having a low pressure inlet connected to the top of the column and through which the tower overhead stream is drawn and entrained in the coolant to form a combined stream and a high pressure outlet through which the combined stream is discharged;

discharging the combined stream to a phase separation tank and separating the tower overhead from the coolant in the phase separation tank; and introducing the tower overhead from the phase separation tank into the bottom region of the column.

* * * * *